US007441531B2

(12) United States Patent
Shiota et al.

(10) Patent No.: US 7,441,531 B2
(45) Date of Patent: Oct. 28, 2008

(54) REVERSE ROTATION PREVENTING MECHANISM FOR DIESEL ENGINE

(75) Inventors: Katsuyuki Shiota, Osaka (JP); Yasuhiro Kanazu, Osaka (JP); Satoshi Hattori, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 23 days.

(21) Appl. No.: 10/577,236

(22) PCT Filed: Aug. 20, 2004

(86) PCT No.: PCT/JP2004/012019

§ 371 (c)(1),
(2), (4) Date: Jan. 17, 2007

(87) PCT Pub. No.: WO2005/040597

PCT Pub. Date: May 6, 2005

(65) Prior Publication Data

US 2007/0272199 A1 Nov. 29, 2007

(30) Foreign Application Priority Data

Oct. 28, 2003 (JP) ..... 2003-367929

(51) Int. Cl.
*F02M 17/30* (2006.01)
*F01L 1/10* (2006.01)

(52) U.S. Cl. ..... 123/198 D; 123/185.13

(58) Field of Classification Search ..... 123/631, 123/630, 198 D, 185.13, 179.17, 508, 90.1, 123/90.16, 206
See application file for complete search history.

(56) References Cited

U.S. PATENT DOCUMENTS 3,810,453 A * 5/1974 Wolfe ..... 123/467
5,566,650 A * 10/1996 Kruse ..... 123/27 R

FOREIGN PATENT DOCUMENTS

| | | | |
|---|---|---|---|
| JP | 52-61627 A | | 5/1977 |
| JP | 125360 | | 8/1985 |
| JP | 03164563 A | * | 7/1991 |
| JP | 06-146938 | | 5/1994 |
| JP | 8-28399 A | | 1/1996 |

OTHER PUBLICATIONS

International Search Report for PCT/JP2004/012019, dated Nov. 30, 2004, 4 pgs.

* cited by examiner

*Primary Examiner*—Mahmoud Gimie
(74) *Attorney, Agent, or Firm*—Sterne, Kessler, Goldstein & Fox P.L.L.C.

(57) ABSTRACT

The invention prevents reverse rotation of a diesel engine which is possible to occur when the engine is started. A camshaft 13 is driven by a crankshaft 5 through power transmission means, and cams 14, 21 and 22 are provided on camshaft 13 so as to drive a fuel injection pump 12, an intake valve and an exhaust valve, respectively. In fuel injection pump cam 14, middle stage portion 53 is radially larger than minimum radius portion 51 and is disposed at a predetermined angle R3 on the back side in the rotation direction of the fuel injection pump cam from maximum radius portion 52.

7 Claims, 6 Drawing Sheets

REVERSE ROTATION PREVENTING MECHANISM FOR DIESEL ENGINE

TECHNICAL FIELD

The invention relates to a reverse rotation preventing mechanism for a diesel engine.

BACKGROUND ART

In a conventional diesel engine, reverse rotation likely occurs at the start thereof. For example, with respect to a manually started diesel engine having a single cylinder, a flywheel is rotated while fuel is injected into the diesel engine under decompression. The decompression is canceled after the rotation speed has risen up. At this time, a large quantity of fuel having been injected during the decompression is gasified and activated according to increase of pressure and temperature, so as to start ignition before the piston reaches its top dead point. Consequently, the piston, even assisted by the inertial rotation of the flywheel, cannot reach the top dead point and is backed by the ignition, whereby the reverse rotation of the diesel engine occurs.

The reverse rotation causes functional exchange between the intake system and the exhaust system, such that air is inhaled into a muffler, and exhausted from an air cleaner. The problem arises that the exhaust gas damages components of the intake system. Therefore, a reverse rotation preventing mechanism is provided on a camshaft for opening and closing an intake or exhaust valve, as disclosed in Japanese Laid-Open Gazette No. Hei 6-146938.

In the reverse rotation preventing mechanism disclosed in the document, a decompression member provided on a camshaft is pressed against an exhaust cam or an intake cam by a spring, so that the decompression member is rotatable following the rotation of the exhaust or intake cam by the frictional pressure. However, the reverse rotation preventing mechanism, requiring additional components such as the decompression member and the spring, causes increase of parts and costs.

DISCLOSURE OF THE INVENTION

Problem to Be Solved by the Invention

The problem to be solved is the reverse rotation of a diesel engine, which likely occurs at the engine start. According to the invention, a reverse rotation preventing mechanism for preventing the reverse rotation is constructed by changing a shape of a cam for a fuel injection pump.

Means for Solving the Problem

A reverse rotation preventing mechanism for a diesel engine according to the present invention comprises: a camshaft driven by a crankshaft through power transmission means; and cams provided on the camshaft so as to drive a fuel injection pump, an intake valve and an exhaust valve, respectively. The cam for the fuel injection pump is shaped so as to include a maximum radius portion, a minimum radius portion, and a middle stage portion. The middle stage portion is radially larger than the minimum radius portion and is disposed at a predetermined angle on the back side in the rotation direction of the fuel injection pump cam from the maximum radius portion.

In the reverse rotation preventing mechanism for a diesel engine according to the present invention, the height of the middle stage portion substantially corresponds to the height of a plunger of the fuel injection pump when injection of the fuel injection pump driven by the cam is completed at the engine start.

In the reverse rotation preventing mechanism for a diesel engine according to the present invention, the height of the middle stage portion is set so that the middle stage portion is prevented from interfering with a rotation locus of an end of a connecting rod.

In the reverse rotation preventing mechanism for a diesel engine according to the present invention, a boundary position between the middle stage portion and a small radius portion is disposed adjacent to a position for starting the opening process of the intake valve.

In the reverse rotation preventing mechanism for a diesel engine according to the present invention, a boundary position between a portion where the radius is gradually reduced from the maximum radius portion and the middle stage portion is disposed adjacent to a position for starting the opening process of the exhaust valve.

Effects of the Invention

In a reverse rotation preventing mechanism for a diesel engine according to the present invention, cams for driving a fuel injection pump, an intake valve and an exhaust valve are provided on a camshaft driven by a crankshaft through power transmission means, the cam for the fuel injection pump is shaped so as to include a maximum radius portion, a minimum radius portion, and a middle stage portion, and the middle stage portion is radially larger than the minimum radius portion and is disposed at a predetermined angle on the back side in the rotation direction of the fuel injection pump cam from the maximum radius portion. Due to the middle stage portion, even if the rotation of the crankshaft is reversed, the fuel injection amount into the cylinder is small so as not to cause ignition, thereby preventing further continuation of the reverse rotation.

In the reverse rotation preventing mechanism for a diesel engine according to the present invention, the height of the middle stage portion substantially corresponds to the height of a plunger of the fuel injection pump when injection of the fuel injection pump driven by the cam is completed at the engine start. Therefore, even if the reverse rotation occurs at the engine start, little fuel is sent from the fuel injection pump to the cylinder so as not to cause ignition, thereby preventing the reverse rotation.

In the reverse rotation preventing mechanism for a diesel engine according to the present invention, since the height of the middle stage portion is determined so that the middle stage portion is prevented from interfering with a rotation locus of an end of a connecting rod, the camshaft can approach the crankshaft as much as possible, thereby miniaturizing the engine.

In the reverse rotation preventing mechanism for a diesel engine according to the present invention, a boundary position between the middle stage portion and a small radius portion is disposed adjacent to a position for starting the opening process of the intake valve. Therefore, even if the reverse rotation occurs, the intake valve is still opened after the fuel injection is completed at a position where the minimum radius portion changes into the middle stage portion so as to prevent fuel from being sucked into the cylinder, thereby preventing ignition. In this way, the reverse rotation is prevented from further continuing, thereby preventing the reverse rotation of the engine at the start.

In the reverse rotation preventing mechanism for a diesel engine according to the present invention, a boundary position between a portion where the radius is gradually reduced from the maximum radius portion and the middle stage portion is disposed adjacent to a position for starting the opening process of the exhaust valve. Therefore, even if the reverse rotation occurs and fuel is supplied from the fuel injection pump to the cylinder, the compression by the piston is performed after gas is exhausted through the opened exhaust valve, thereby hardly causing ignition. Even when the plunger is further raised in the fuel injection pump, the cylinder is not supplied with fuel because it is after the delivery of fuel, thereby preventing ignition and preventing the reverse rotation of the engine.

DESCRIPTION OF NOTATIONS

5 Crankshaft
12 Fuel Injection Pump
13 Camshaft
14 Fuel Injection Pump Cam
21 Intake Cam
22 Exhaust Cam
51 Minimum Radius Portion
52 Maximum Radius Portion
53 Middle Stage Portion

BEST MODE FOR CARRYING OUT THE INVENTION

Figure 1:
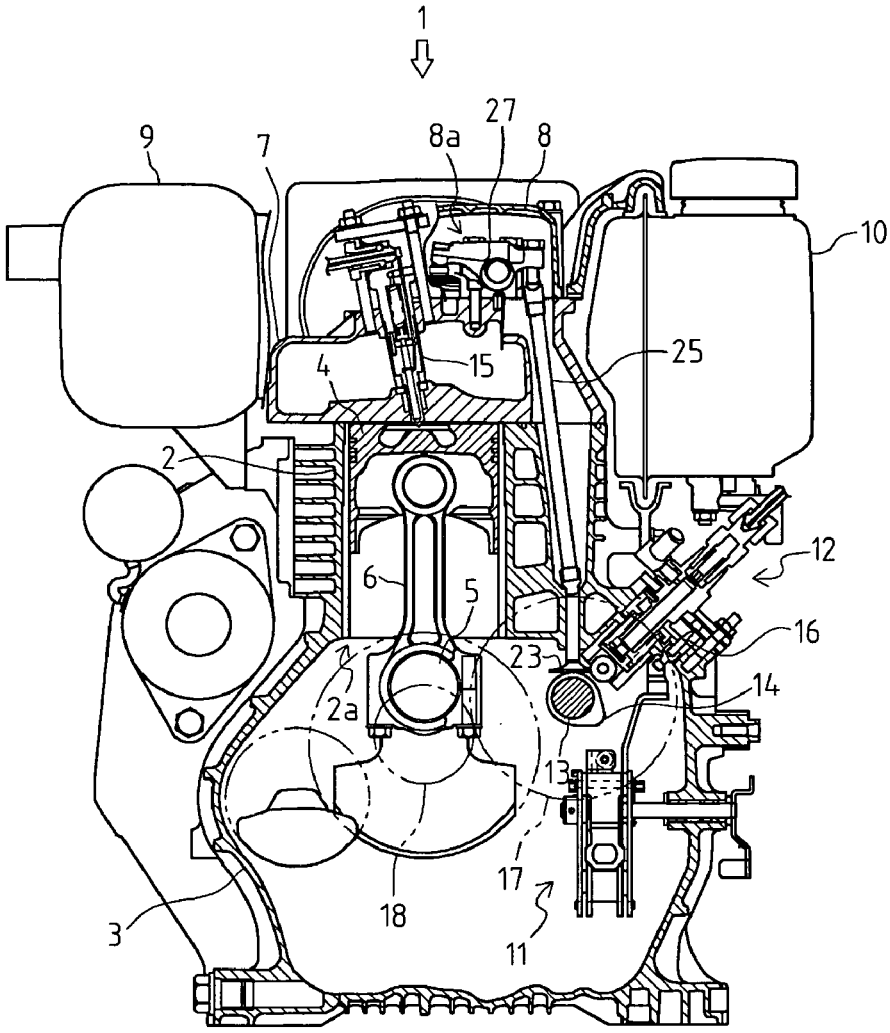
FIG. 1 is a sectional front view of an engine according to the present invention.

A general structure of an engine according to the present invention will be described with reference to FIGS. 1 to 4. As shown in FIG. 1, a main body of an engine 1 comprises an upper cylinder block 2 and a lower crankcase 3. Cylinder block 2 is formed in a center portion thereof with a vertical cylinder 2*a* in which a piston 4 is fitted. A cylinder head 7 is disposed above cylinder block 2. A bonnet cover 8 is disposed above cylinder head 7 so as to provide a rocker arm chamber 8*a*, which incorporates rocker arms 27 and 28, upper portions of an intake valve 31 and an exhaust valve 32, upper portions of pushrods 25 and 26, and so on. At the upper portion of engine 1, muffler 9 is disposed on one side (left in FIG. 1) of bonnet cover 8, and a fuel tank 10 is disposed on the other side (right in FIG. 1) of bonnet cover 8.

Referring to FIG. 1, a crankshaft 5 is journalled in the fore-and-aft direction in crankcase 3, and connected to piston 4 through a connecting rod 6. In crankcase 3 are disposed a balance weight, a governor 11 and so on. A fuel injection pump 12, a camshaft 13 and so on are disposed above governor 11. Camshaft 13 is journalled in parallel to crankshaft 5. A cam gear 17 is fixed on one end of camshaft 13, and meshes with a gear 18 fixed on one end of crankshaft 5, so that power can be transmitted from crankshaft 5 to camshaft 13 through gear 18 and cam gear 17.

Figure 2:
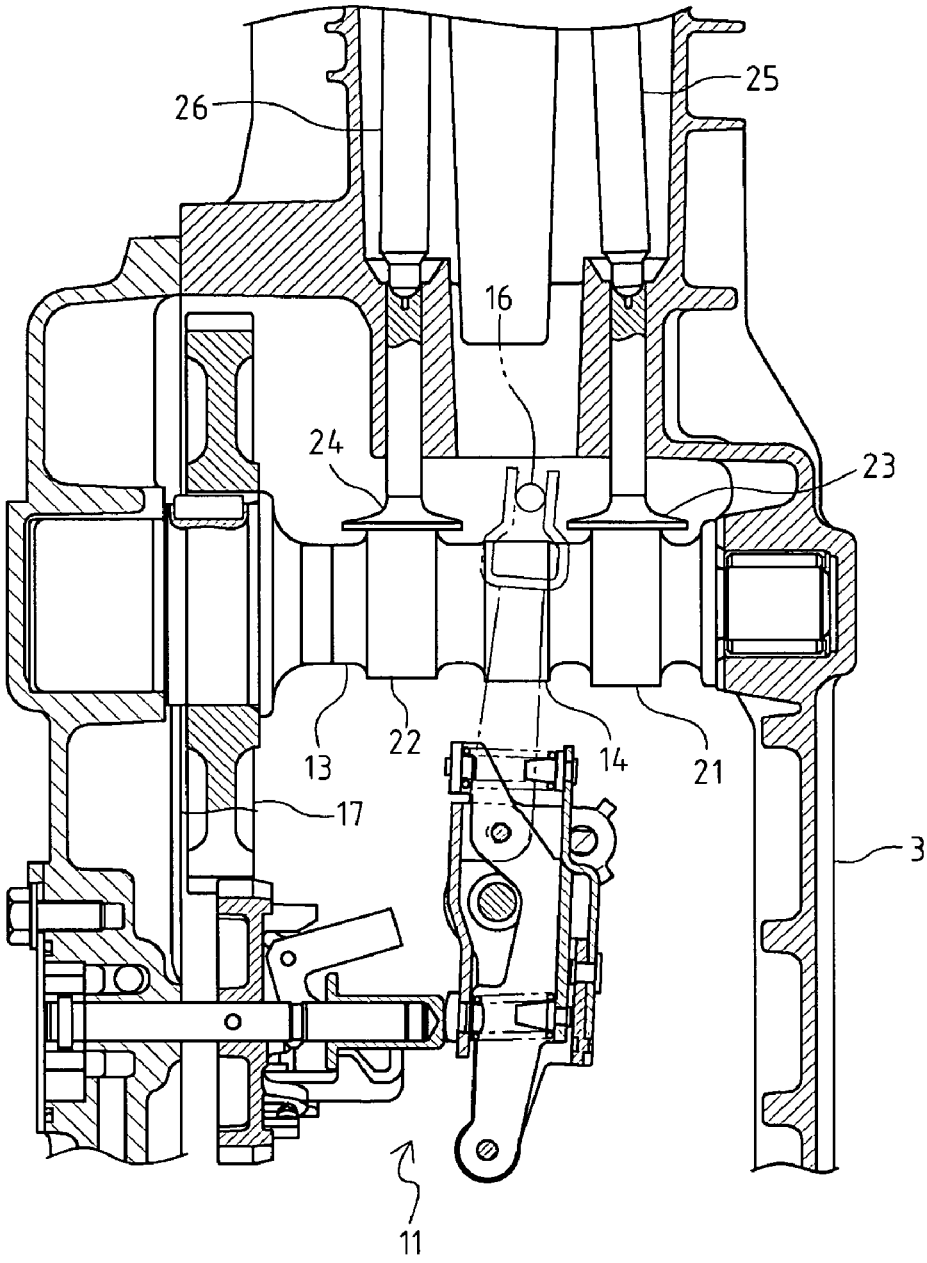
FIG. 2 is a sectional side view of a lower portion of the engine according to the present invention.
Figure 3:
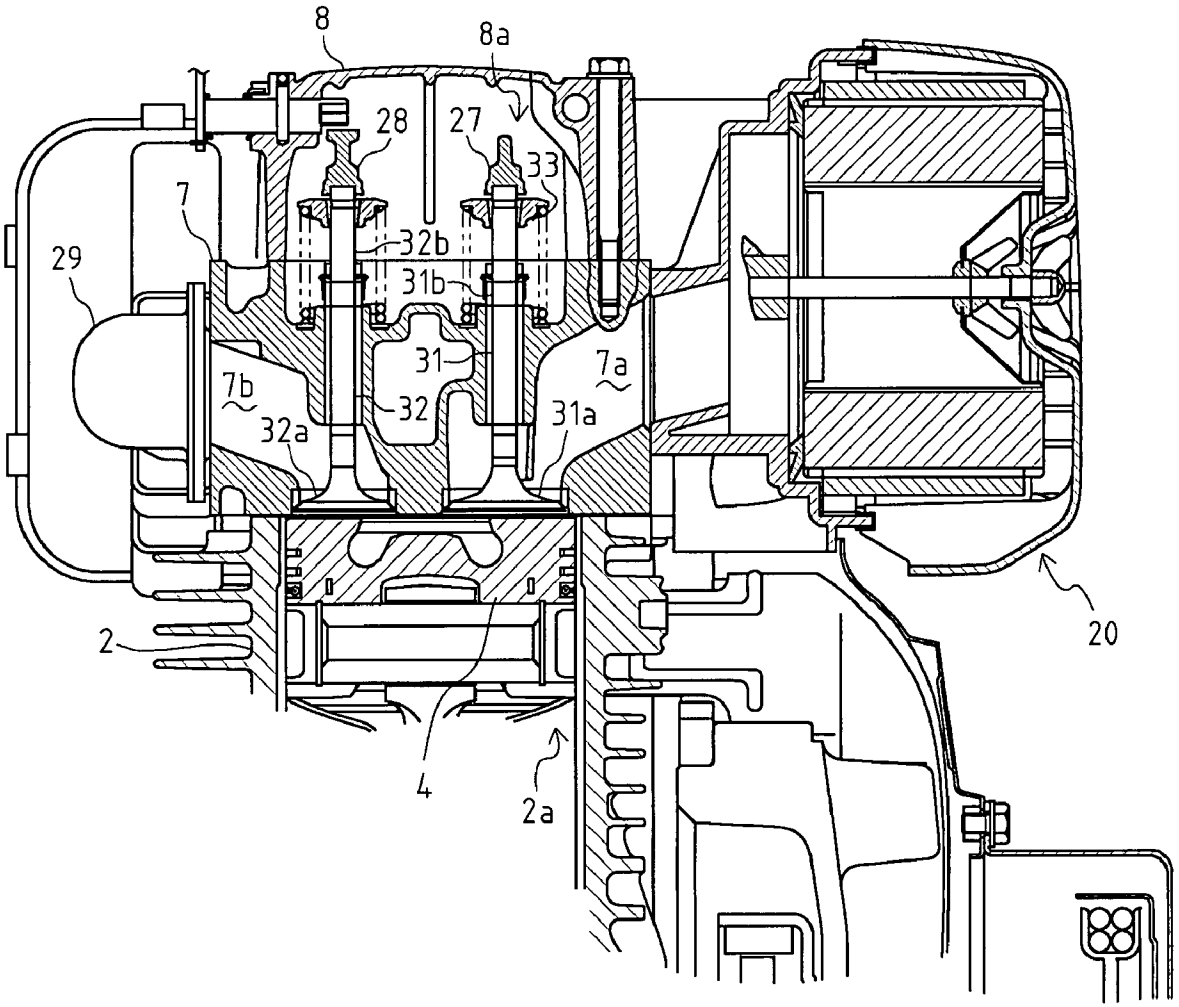
FIG. 3 is a sectional side view of an upper portion of the engine according to the present invention.

As shown in FIG. 2, on an intermediate portion of camshaft 13 is disposed an intake cam 21 and an exhaust cam 22 at a certain interval, and disposed a fuel injection pump cam 14 between intake cam 21 and exhaust cam 22. Intake cam 21 and exhaust cam 22 abut against respective tappets 23 and 24. Intake pushrod 25 and exhaust pushrod 26 are connected at bottom ends thereof to respective tappets 23 and 24, and extended at top ends thereof into rocker arm chamber 8*a* in bonnet cover 8 through a vertical rod hole bored within cylinder block 2 and cylinder head 7. As shown in FIG. 3, intake rocker arm 27 and exhaust rocker arm 28 abut at bottom ends of one sides thereof against top ends of intake pushrod 25 and exhaust pushrod 26, and abut at bottom ends of the other sides thereof against top ends of intake valve 31 and exhaust valve 32, respectively.

Intake valve 31 (exhaust valve 32), including a valve head 31*a* (32*a*) and a valve rod 31*b* (32*b*), is disposed above piston 4. Valve head 31*a* (32*a*) is disposed so as to be fitted or separated onto and from a valve seat formed on a lower surface of cylinder head 7, thereby opening or shutting an intake port 7*a* (an exhaust port 7*b*) formed within cylinder head 7 to and from a combustion chamber of cylinder 2*a* formed within cylinder block 2. Intake port 7*a* is connected to air cleaner 20 disposed on one side surface (a rear surface) of cylinder head 7. Exhaust port 7*b* is connected to muffler 9 through an exhaust manifold 29.

Valve rod 31*b* (32*b*) slidably projects upward toward bonnet cover 8 through cylinder head 7, and abuts at a top end thereof against rocker arm 27 (28). In rocker arm 8*a*, a spring 33 (33) is wound around valve rod 31*b* (32*b*) so as to upwardly slidably bias valve head 31*a* (32*a*) in the direction for closing intake valve 31 (exhaust valve 32).

Accordingly, when crankshaft 5 rotates, camshaft 13 is rotated through gear 18 and cam gear 17. Due to the rotation of camshaft 13, intake cam 21 and exhaust cam 22 raise and lower respective tappets 23 and 24. Due to the raising and lowering of tappets 23 and 24, intake valve 31 and exhaust valve 32 are vertically reciprocally slid to be opened and closed through pushrods 25 and 26 and rocker arms 27 and 28, respectively. Namely, intake valve 31 and exhaust valve 32 are opened and closed according to rotation of intake cam 21 and exhaust cam 22 on camshaft 13, respectively.

A fuel injection nozzle 15 is disposed between intake valve 31 and exhaust valve 32. Fuel injection nozzle 15 penetrates cylinder head 7 downward so as to be disposed at a tip (delivery portion) thereof above the center of cylinder 2*a*, thereby injecting fuel supplied from fuel injection pump 12 into cylinder 2*a*.

Figure 4:
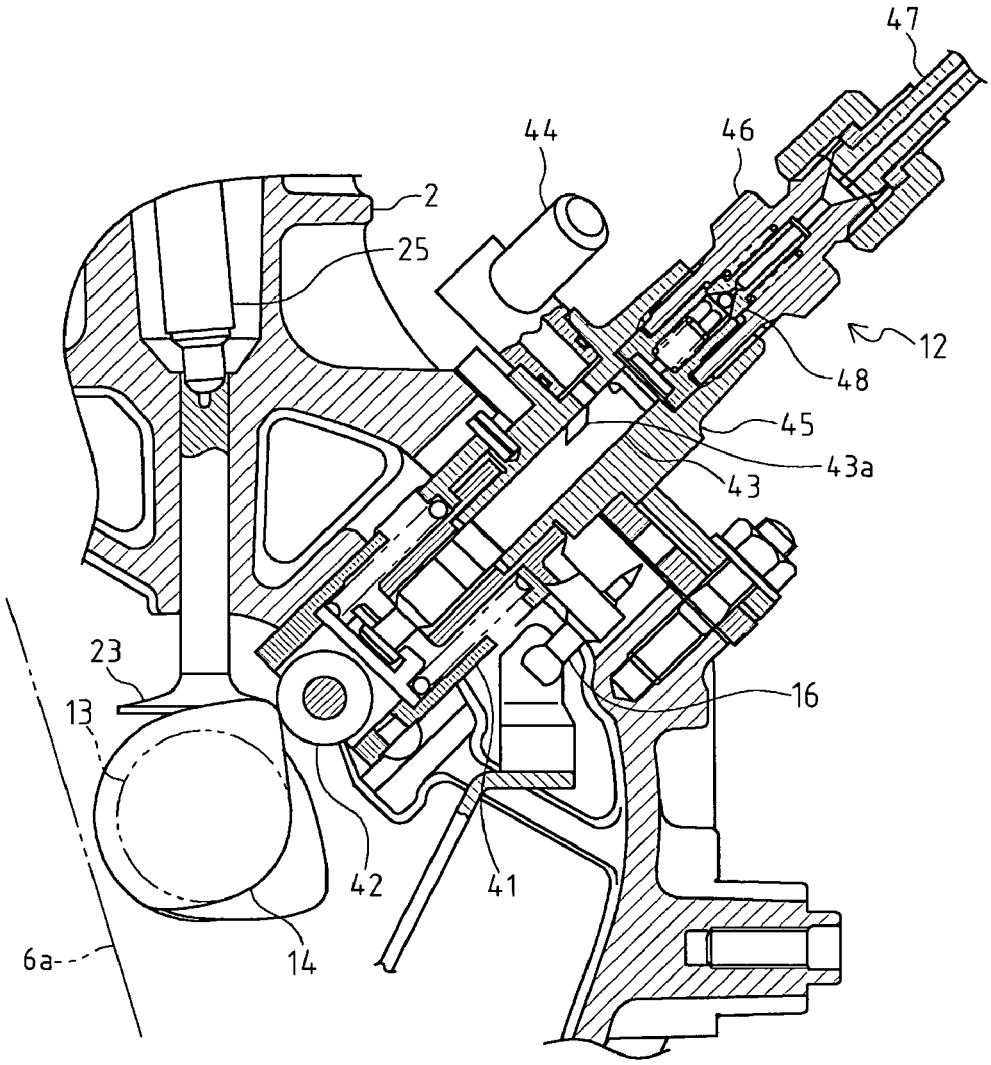
FIG. 4 is a sectional view of a fuel injection pump.

As shown in FIG. 4, fuel injection pump 12 and camshaft 13 are disposed above governor 11 disposed in crankcase 3. In fuel injection pump 12, a roller 42 pivoted on a tappet 41 abuts against fuel injection pump cam 14 disposed on camshaft 13 between intake cam 21 and exhaust cam 22. A plunger 43 is slidably reciprocated through roller 42 and tappet 41 by the rotation of fuel injection pump cam 14 so as to suck fuel from fuel tank 10 into a plunger barrel 45. When roller 42 is raised by the further rotation of fuel injection pump cam 14 so as to raise plunger 43 through roller 42 and tappet 41, fuel in plunger barrel 45 is compressed, and a delivery valve 48 is opened to supply a determined quantity of fuel to fuel injection nozzle 15 through a delivery port 46 and a high-pressure pipe 47 at a predetermined timing.

A control lever 16 of fuel injection pump 12 is rotated by governor 11 so as to change a stroke of plunger 43, thereby regulating the fuel injection quantity from fuel injection nozzle 15.

Figure 5:
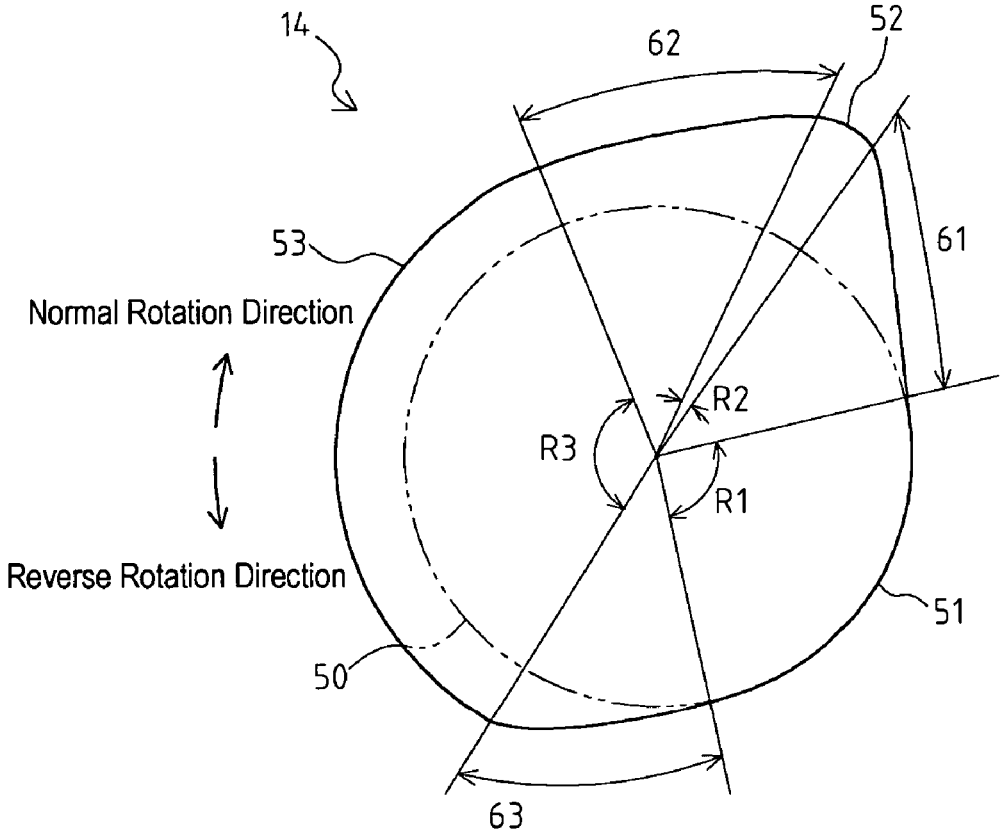
FIG. 5 is a side view of a shape of a cam for the fuel injection pump.

Fuel injection cam 14 disposed on camshaft 13 will be described with reference to FIGS. 4, 5 and 6. Fuel injection pump cam 14 is shaped so as to vary in radius corresponding to the reciprocation of piston 4 and the rotational angle of crankshaft 5. More specifically, fuel injection pump cam 14 varies from a minimum radius portion to a maximum radius portion along the rotation direction, and is formed with a middle stage portion which is radially larger than the minimum radius portion. The minimum radius portion is formed on the back side in the rotation direction from the middle stage portion.

Variation of fuel injection pump cam 14 along the rotation direction will be described. When plunger 43 of fuel injection pump 12 is placed at the maximum extension stroke (uncompressing position), roller 42 is disposed so as to contact a base circle 50 represented as the minimum radius portion of fuel injection pump cam 14. Fuel injection pump cam 14 is formed with a portion in a range of a predetermined angle R1 disposed on base circle 50, which is referred to as a minimum radius portion 51. The range of angle R1 corresponds to the period from when the opening process of intake valve 31 is completed (intake valve 31 is completely opened) until the opening process of plunger 43 starts, as shown in FIG. 6.

The radius of fuel injection pump cam 14 at a slant portion 61 becomes larger and larger than base circle 50. After passing slant portion 61, fuel injection pump cam 14 is formed with a maximum radius portion 52 projecting radially outward in a range of a predetermined angle R2. Maximum radius portion 52 corresponds to the maximum contraction stroke (compressing position) of plunger 43.

The radius of fuel injection pump cam 14 at a slant portion 62 is gradually reduced. After passing slant portion 62, fuel injection pump cam 14 is formed with a middle stage portion 53, which is radially larger than minimum radius portion 51, in a range of predetermined angle R3 on the back side in the rotation direction of fuel injection pump cam 14 from maximum radius portion 52. Referring to FIG. 6, angle R3 is determined so that the boundary position of middle stage portion 53 against the portion where the radius is gradually reduced from maximum radius portion 52 is located adjacent to a position for starting the opening process of exhaust valve 32, and that the boundary position of middle stage portion 53 against the portion where the radius is changed with passing to middle stage portion 51 corresponds to a position for almost closing exhaust valve 32. In other words, the range of predetermined angle R3 is set so as to substantially correspond to the period from when the opening process of exhaust valve 32 starts until the closing process of exhaust valve 32 is almost completed.

The boundary position of middle stage portion 53 against a slant portion 63, where the radius changes with passing from middle stage portion 53 to minimum radius portion 51, also corresponds to a position for starting the opening process of intake valve 31, i.e., adjacent to a position for opening both intake valve 31 and exhaust valve 32.

In this way, fuel injection pump cam 14 is formed with minimum radius portion 51, maximum radius portion 52 and middle stage portion 53 aligned in the rotation direction along base circle 50.

The height, i.e., radius, of middle stage portion 53 is determined so as to prevent middle stage portion 53 from interfering with a rotation locus 6*a* of a right end of connecting rod 6 shown in FIG. 1 at any phase. In this regard, when piston 4 rises from the bottom dead point (BDC) to the top dead point (TDC), connecting rod 6 swung rightward in FIG. 1 is prevented from abutting at the side surface against fuel injection pump cam 14, however, the gap between the both members approaching each other, i.e., the gap between middle stage portion 53 and the rotation locus of the end of connecting rod 6 is extremely reduced.

In this way, when fuel injection pump cam 14 is rotated by the drive force transmitted to camshaft 13 through gear 18 and cam gear 17 from connecting rod 6 rotated by the rotation of crankshaft 5, fuel injection pump cam 14 and connecting rod 6 are prevented from interfering with each other, so that parallel crankshaft 5 and camshaft 13 disposed in crankcase 3 can extremely approach each other, thereby miniaturizing engine 1. Incidentally, fuel injection pump cam 14 rotates twice every one rotation of crankshaft 5. Therefore, at the second compression process, there is no problem of interference between fuel injection pump cam 14 and connecting rod 6 because, when fuel injection pump cam 14 approaches connecting rod 6, minimum radius portion 51 is faced to connecting rod 6.

Figure 6:
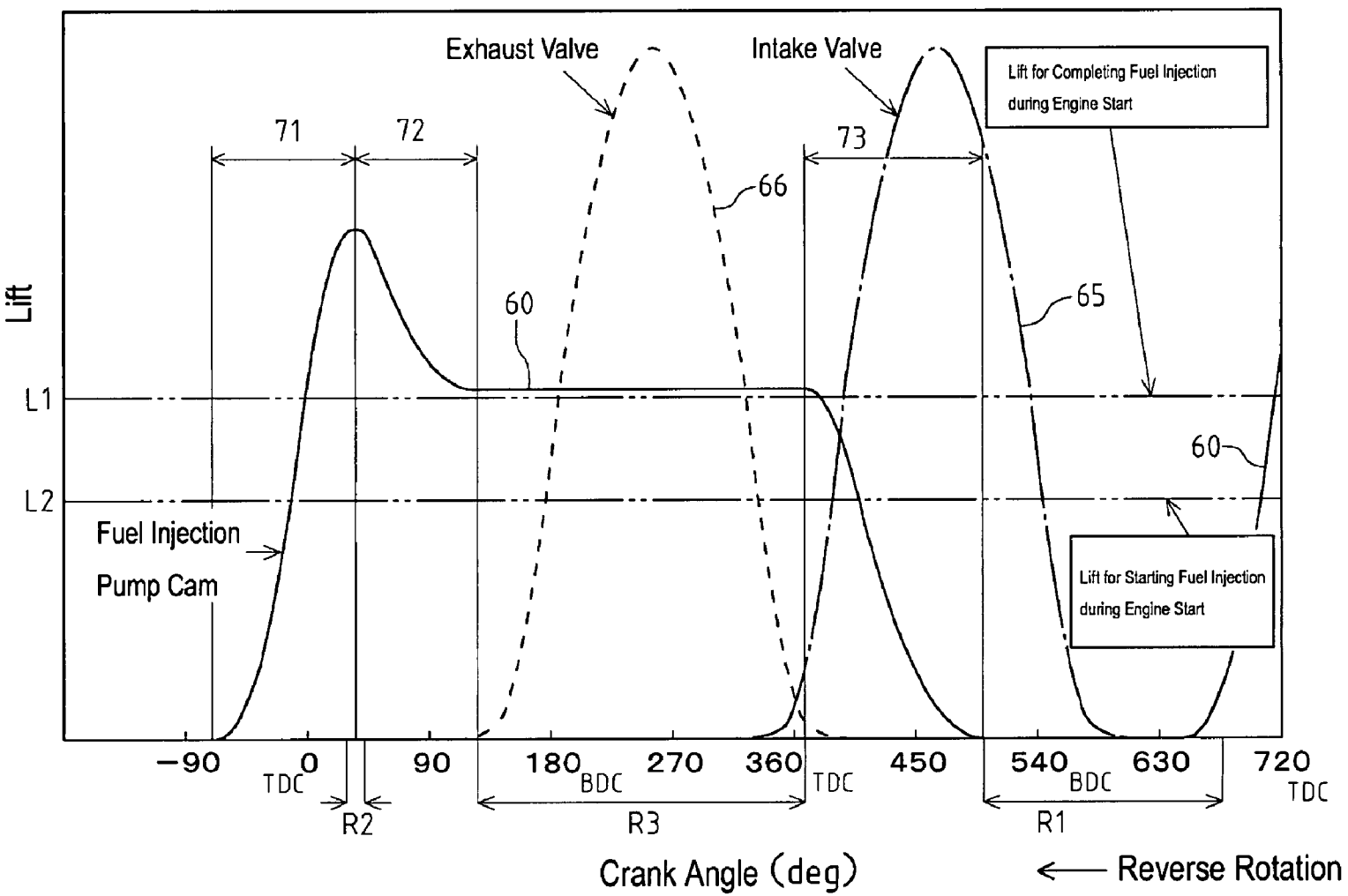
FIG. 6 is a graph of a profile of the cam for the fuel injection pump.

Further, referring to FIG. 6, in a profile 60 of fuel injection pump cam 14 abutting against roller 42 of fuel injection pump 12, slant portion 61 between minimum radius portion 51 for minimizing the lift of plunger 43 and maximum radius portion 52 for maximizing the lift of plunger 43 is disposed so as to substantially correspond to a raising lift period 71. At the middle of raising lift period 71, piston 4 reaches the top dead point (TDC) so as to cause ignition. At this time, intake valve 31 is closed so as to keep the fuel compression state due to fuel injection pump cam 14.

Referring to FIG. 6, slant portion 62, where the radius is gradually reduced from maximum radius portion 52 to middle stage portion 53, substantially corresponds to a first lowering lift period 72. Middle stage portion 53 is designed so that the lift of raising plunger 43 by middle stage portion 53 substantially corresponds to the lift of raising plunger 43 for completing fuel injection of fuel injection pump 12 at the engine starting. In other words, the height of middle stage portion 53 from base circle 50 substantially corresponds to the position of plunger 43 lifted by the rotation of cam 14 when the injection of fuel injection pump 12 for engine starting is completed.

In this regard, as shown in FIG. 4, plunger 43 is peripherally formed at a top portion thereof (on the opposite side to tappet 41) with a lead (spiral notch) 43*a* opened into plunger barrel 45. Plunger 43 is rotated by rotating control lever 16. Fuel is sucked from a suction port 44 into plunger barrel 45 through lead 43*a*. At the engine starting, when a rotary speed setting lever is rotated to rotate control lever 16, plunger 43 is rotated so as to adjust the position of lead 43*a*, thereby setting the fuel suction quantity. Since this state, plunger 43 slides in the contraction direction, so as to compress and deliver fuel. When the slide of plunger 43 reaches a certain degree, suction port 44 is opened to lead 43*a* so as to complete the fuel injection. This plunger position for completing the fuel injection is referred to as an engine-starting injection completing lift L1. The height of middle stage portion 53 is designed to substantially correspond to engine-starting injection completing lift L1. Angle range R3 of middle stage portion 53 is determined to substantially correspond to a range of a profile 66 of exhaust cam 22 for the opening period of exhaust valve 32 from its opening until its closing.

Referring to FIG. 6, a slant portion 63 where the radius is reduced from middle stage portion 53 to minimum radius portion 51 substantially corresponds to a second lowering lift period 73 due to a profile 65 of intake cam 21 from when intake valve 31 starts to be opened until intake valve 31 is fully opened. More specifically, referring to FIG. 6, a lift L2 is designed to establish a position of plunger 43 sliding in the contraction direction for starting compression of fuel for engine starting so as to increase the pressure of fuel in plunger barrel 45 and to open delivery valve 48 interposed between plunger barrel 45 and high-pressure pipe 47. The lift difference between lift L2 and L1 corresponds to the fuel injection quantity for engine starting. Due to this arrangement, the injection of fuel during a later-discussed reverse rotation is reduced so as to prevent further reverse rotation.

In this way, fuel injection pump cam 14 is designed so that the period for plunger-lowering for eliminating the plunger-raising lift achieved at raising lift period 71 is divided into first lowering lift period 72 and second lowering lift period 73.

In this construction, when the reverse rotation occurs in the engine at its starting, fuel injection pump cam 14 also rotates in the reverse direction so that the contact between cam 14 and roller 42 moves from minimum radius portion 51 to middle stage portion 53. When roller 42 contacts slant portion 63, i.e., at second lowering lift period 73, and when plunger 43 rises (for compression) beyond lift L2, fuel injection starts. At this time, the position of intake valve 31 due to profile 65 of intake cam 21 is in the midway of being closed from the state where it is fully opened, i.e., the raising lift of intake cam 21 is maximum.

In this way, even when the engine starts reverse rotation, fuel injection starts at second lowering lift period 73 corresponding to the cam range from minimum radius portion 51 to middle stage portion 53, immediately before intake valve 31 is fully closed. Therefore, the fuel is exhausted from intake port 7*a*, so that the quantity of fuel supplied into cylinder 2*a* is so small as to be insufficient for ignition. Consequently, the engine is prevented from being further rotated in the reverse direction, i.e., the reverse rotation at the engine start is prevented. Incidentally, at this time, piston 4 is rising so that little fuel is introduced into cylinder 2*a*.

Further, plunger 43 reaches middle stage portion 53 to complete fuel injection before it reaches the position for opening both intake valve 31 and exhaust valve 32. The opening process of exhaust valve 32 starts before piston 4 reaches the top dead point, whereby opened exhaust valve 32 exhausts remaining fuel.

Since the height of middle stage portion 53 substantially corresponds to the height of plunger 43 for completing fuel injection of fuel injection pump 12, even when the started engine rotates in the reverse direction, little fuel is injected before the compression of fuel by fuel injection pump 12 peaks, i.e., little fuel is supplied to the combustion chamber of cylinder 2*a*. Consequently, no ignition occurs in the combustion chamber, thereby preventing further reverse rotation of the engine.

After the fuel injection is competed, roller 42 contacts middle stage portion 53 of fuel injection pump cam 14. While roller 42 contacts middle stage portion 53, exhaust valve 32 is opened and closed due to profile 66 of exhaust cam 22.

Due to this arrangement, during the engine reverse rotation, even when fuel is supplied from fuel injection pump 12 into cylinder 2*a*, the fuel is hardly led to ignition because piston 4 compresses the fuel after exhaust valve 32 is opened for exhaustion. Afterward, even when fuel in fuel injection pump 12 is compressed, fuel supply to cylinder 2*a* causing ignition is prevented because delivery port 46 of plunger 43 for fuel supply is closed. Consequently, engine 1 is prevented from being rotated in the reverse direction.

As mentioned above, in the arrangement that cams 14, 21 and 22 for respective driving of fuel injection pump 12, intake valve 31 and exhaust valve 32 are disposed on camshaft 13 driven by crankshaft 5 through power transmission means, middle stage portion 53 is radially larger than minimum radius portion 51 and disposed in fuel injection pump cam 14 at predetermined angle R3 on the back side in the rotation direction from maximum radius portion 52. Therefore, even if crankshaft 5 rotates in the reverse direction during the engine start, fuel remaining in cylinder 2*a* is so little as to prevent ignition, thereby preventing the engine from being further rotated in the reverse direction.

INDUSTRIAL APPLICABILITY

The reverse rotation preventing mechanism for a diesel engine according to the present invention is industrially useful for preventing reverse rotation of a diesel engine.

What is claimed is:

1. A reverse rotation preventing mechanism for a diesel engine comprising:

a camshaft driven by a crankshaft through power transmission means;

an intake cam provided on the camshaft so as to drive an intake valve;

an exhaust cam provided on the camshaft so as to drive an exhaust valve; and a single fuel injection pump cam provided on the camshaft so as to drive a fuel injection pump, wherein the single fuel injection pump cam is shaped so as to include a rotatably integral maximum radius portion, minimum radius portion, and middle stage portion, and wherein the middle stage portion is radially larger than the minimum radius portion and is disposed in a predetermined angle range on the back side in the rotation direction of the single fuel injection pump cam from the maximum radius portion.

2. The reverse rotation preventing mechanism for a diesel engine according to claim 1, wherein the height of the middle stage portion substantially corresponds to a lifted position of a plunger of the fuel injection pump when injection of the fuel injection pump driven by the cam is completed at the engine start.

3. The reverse rotation preventing mechanism for a diesel engine according to claim 1, wherein the height of the middle stage portion is determined so that the middle stage portion is prevented from interfering with a rotation locus of an end of a connecting rod.

4. The reverse rotation preventing mechanism for a diesel engine according to claim 1, wherein a boundary position between the middle stage portion and a radius-reduced portion where the radius is reduced to the minimum radius portion is disposed adjacent to a position for starting the opening process of the intake valve.

5. The reverse rotation preventing mechanism for a diesel engine according to claim 1, wherein a boundary position between a portion where the radius is gradually reduced from the maximum radius portion and the middle stage portion is disposed adjacent to a position for starting the opening process of the exhaust valve.

6. The reverse rotation preventing mechanism for a diesel engine according to claim 1, wherein the single fuel injection pump cam includes a single maximum radius portion.

7. The reverse rotation preventing mechanism for a diesel engine according to claim 1, wherein the predetermined angle range corresponds to a profile of the exhaust cam for an opening period of the exhaust valve from its opening until its closing.

* * * * *